US011627802B1

(12) United States Patent
Liu

(10) Patent No.: US 11,627,802 B1
(45) Date of Patent: Apr. 18, 2023

(54) MODULAR RACK ASSEMBLY

(71) Applicant: TAIWAN SHIN YEH ENTERPRISE CO., LTD., Chiayi County (TW)

(72) Inventor: Hung-Tsun Liu, Chiayi (TW)

(73) Assignee: TAIWAN SHIN YEH ENTERPRISE CO., LTD., Chiayi County (TW)

( * ) Notice: Subject to any disclaimer, the term of this patent is extended or adjusted under 35 U.S.C. 154(b) by 0 days.

(21) Appl. No.: 17/728,559

(22) Filed: Apr. 25, 2022

(51) Int. Cl.
*A47B 57/48* (2006.01)
*A47B 57/54* (2006.01)
*A47F 5/10* (2006.01)

(52) U.S. Cl.
CPC ..... *A47B 57/487* (2013.01); *A47B 57/545* (2013.01); *A47F 5/101* (2013.01)

(58) Field of Classification Search
CPC ..... A47B 57/487; A47B 57/545; A47B 57/54; A47F 5/101
See application file for complete search history.

(56) References Cited

U.S. PATENT DOCUMENTS 3,485,381 A * 12/1969 Grubb ..... A47F 5/101 211/186
4,706,576 A * 11/1987 James ..... A47B 57/545 108/106
4,852,501 A * 8/1989 Olson ..... A47B 57/265 108/107
4,934,858 A * 6/1990 Beaulieu ..... F16B 12/40 403/174
5,415,302 A * 5/1995 Carlson ..... A47B 57/265 211/187
6,364,138 B1 * 4/2002 Chen ..... A47B 57/26 211/187
6,431,090 B1 * 8/2002 Davis ..... A47B 57/04 108/107
6,971,528 B2 * 12/2005 Chen ..... A47B 57/40 211/187
7,093,728 B2 * 8/2006 Chen ..... A47B 57/545 211/187
7,543,540 B2 * 6/2009 Tatematsu ..... F16B 12/46 108/192
7,832,571 B2 * 11/2010 Felsenthal ..... A47F 5/137 211/134

(Continued)

FOREIGN PATENT DOCUMENTS

EP 3421322 A1 * 1/2019 ..... A47F 5/101
FR 2628157 A1 * 9/1989
WO WO-2013152491 A1 * 10/2013 ..... A47B 47/0083

*Primary Examiner* — Stanton L Krycinski
(74) *Attorney, Agent, or Firm* — Muncy, Geissler, Olds & Lowe, P.C.

(57) ABSTRACT

A modular rack assembly includes upright support legs, two first shelf units, and a second shelf unit. Each upright support leg has two spaced-apart first hole units, and a plurality of spaced-apart second holes disposed between the first hole units. The first shelf units are connected to the upright support legs through the first hole units. The second shelf unit is engaged to the second holes of the upright support legs which are at the same height, and includes a second shelf plate formed with insertion holes, and supporting members that are engaged to the second holes at the same height and that are inserted into the insertion holes to support the second shelf plate.

5 Claims, 6 Drawing Sheets

(56) References Cited

U.S. PATENT DOCUMENTS

| | | | | |
|---|---|---|---|---|
| 7,992,730 | B2 * | 8/2011 | Huang | A47B 57/265 211/187 |
| 8,016,140 | B2 * | 9/2011 | Hsieh | A47B 47/0083 211/187 |
| 8,042,477 | B2 * | 10/2011 | Lee | A47B 57/54 108/147.12 |
| 8,047,478 | B1 * | 11/2011 | Krauss | A63B 9/00 211/182 |
| 8,118,181 | B2 * | 2/2012 | Shinozaki | A47B 47/0083 211/208 |
| 8,286,564 | B2 * | 10/2012 | Karl | A47B 57/545 108/107 |
| 8,584,873 | B2 * | 11/2013 | Horn | A47B 47/0083 211/187 |
| 8,640,893 | B2 * | 2/2014 | Kessell | A47B 57/545 211/187 |
| 9,380,868 | B1 * | 7/2016 | Fu | A47B 47/0083 |
| 9,930,961 | B2 * | 4/2018 | Kessell | A47B 57/545 |
| 10,455,935 | B1 * | 10/2019 | Chen | A47B 47/027 |
| 10,945,527 | B2 * | 3/2021 | Vanliefde | A47B 47/027 |
| 2004/0065633 | A1 * | 4/2004 | Chen | A47F 5/13 211/175 |

* cited by examiner

MODULAR RACK ASSEMBLY

FIELD

The disclosure relates to a modular rack assembly, and more particularly to a modular rack assembly that has a plurality of removable shelf units for placement of articles.

BACKGROUND

FIG. 1 illustrates a corner portion of a conventional modular rack assembly 9 that includes four support rods 91, a plurality of limiting members 92, and a plurality of shelf units 93 arranged in a top-bottom direction of the modular rack assembly 9 and connected to the support rods 91. Each support rod 91 has a plurality of annular grooves 911 spaced apart from each other in the top-bottom direction. Each limiting member 92 has two truncated half conical portions 921 interconnected with each other at a pivot side, two teeth portions 922 respectively disposed on inner surfaces of the truncated half conical portions 921, and two engaging portions 923 disposed respectively on the truncated half conical portions 921. Each limiting member 92 can be positioned to a corresponding one of the support rods 91 by engagement of the teeth portions 922 with one of the annular grooves 911 of the corresponding support rod 91, such that the truncated half conical portions 921 are not easily detached from the corresponding support rod 91 by snap fitting of the engaging portions 923.

Each shelf unit 93 includes a shelf member 931 and four engagement collars 932 respectively disposed on four corners of the shelf member 931. Each engagement collar 932 has a truncated conical shape and is movably sleeved on and positioned to a periphery of one of the limiting members 92. With the engagement collars 932, each shelf unit 93 is fixed to the limiting members 92 and is connected to the support rods 91 so that the shelf member 931 of each shelf unit 93 can support the articles (not shown).

Because the shelf units 93 are sequentially connected to the support rods 91 in the spaced-apart manner from the bottom to the top, if a selected intermediate one of the shelf units 93 needs to be removed or added at a target height, the articles have to be first removed from the shelf units 93 disposed above the target height, and then the shelf units 93 and corresponding ones of the limiting members 92 above the target height are removed. Thereafter, the selected intermediate shelf unit 93 and the limiting members 92 are removed or added at the target height. Afterwards, the previously removed shelf units 93 and the previously removed limiting members 92 are returned to their original places for placement of the previously removed articles. In use, such shelf removal and addition process is time-consuming and labor-consuming.

SUMMARY

Therefore, an object of the disclosure is to provide a modular rack assembly that can alleviate at least one of the drawbacks of the prior art.

According to the disclosure, a modular rack assembly includes a support rod module and a shelf module.

The support rod module includes a plurality of upright support legs spaced apart from each other. Each of the upright support legs has at least two first hole units spaced apart from each other in a top-bottom direction, and a plurality of second holes that are disposed between the at least two first hole units and that are spaced apart from each other in the top-bottom direction.

The shelf module is removably mounted to the support rod module, and includes two first shelf units and at least one second shelf unit. The first shelf units are spaced apart from each other in the top-bottom direction. Each of the first shelf units is removably engaged to a corresponding one of the at least two first hole units of each of the upright support legs. Each of the first shelf units includes a plurality of position-limiting members each of which is removably engaged to a corresponding one of the at least two first hole units of a respective one of the upright support legs, a first shelf plate disposed among the upright support legs, and a plurality of sleeves that are connected to the first shelf plate and that are removably and respectively sleeved on the position-limiting members such that downward removal of the sleeves from the position-limiting members is prevented.

The at least one second shelf unit is removably engaged to ones of the second holes of the upright support legs which are at the same height. The at least one second shelf unit includes a second shelf plate that is disposed among the upright support legs and that has a plurality of insertion holes open downwardly, and a plurality of supporting members that are removably and respectively engaged to the ones of the second holes at the same height and that are respectively inserted into the insertion holes to support the second shelf plate.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
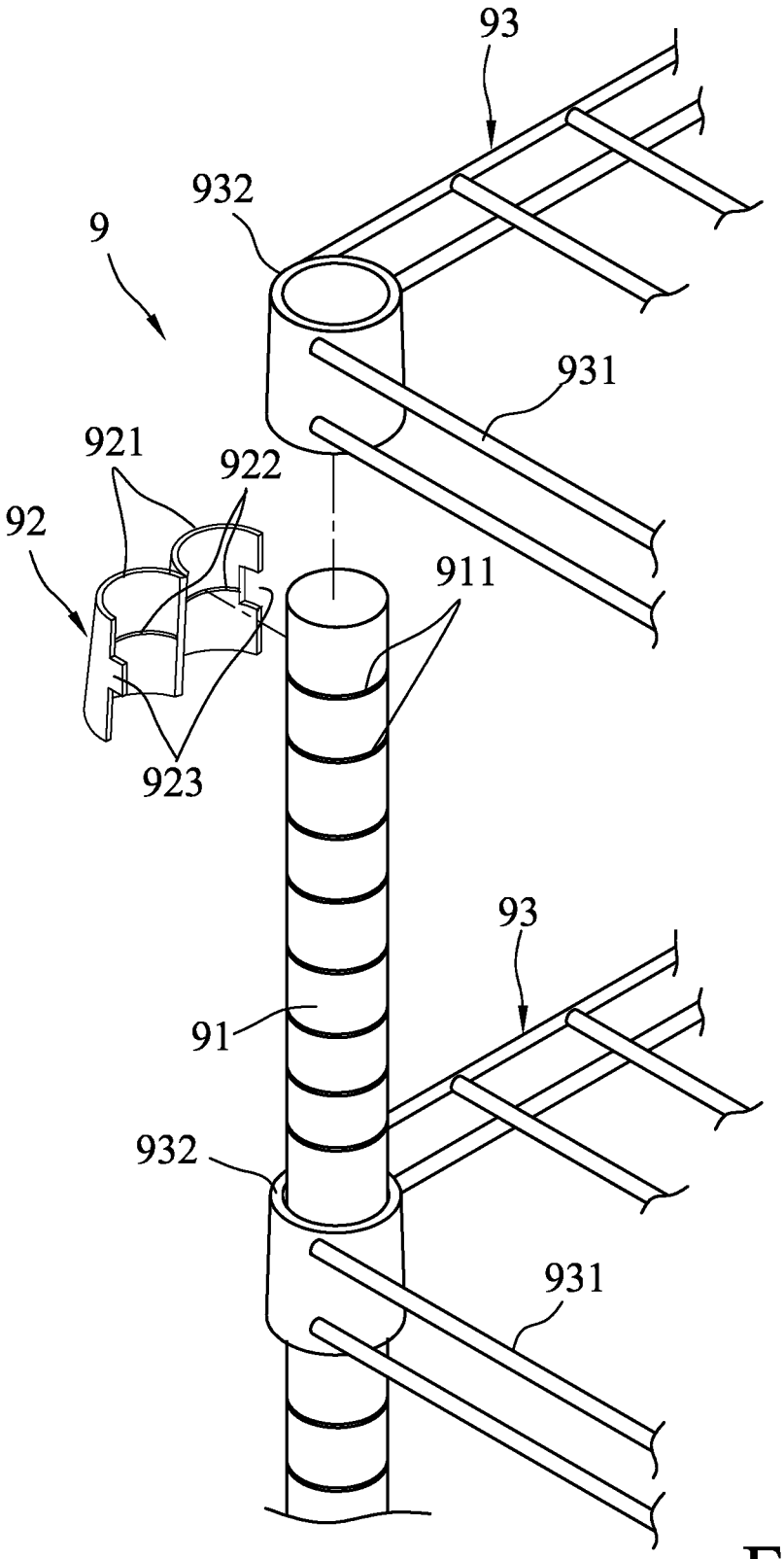
FIG.1 PRIOR ART
FIG. 1 is a fragmentary partly exploded perspective view illustrating a corner portion of an existing modular rack assembly.
Figure 2:
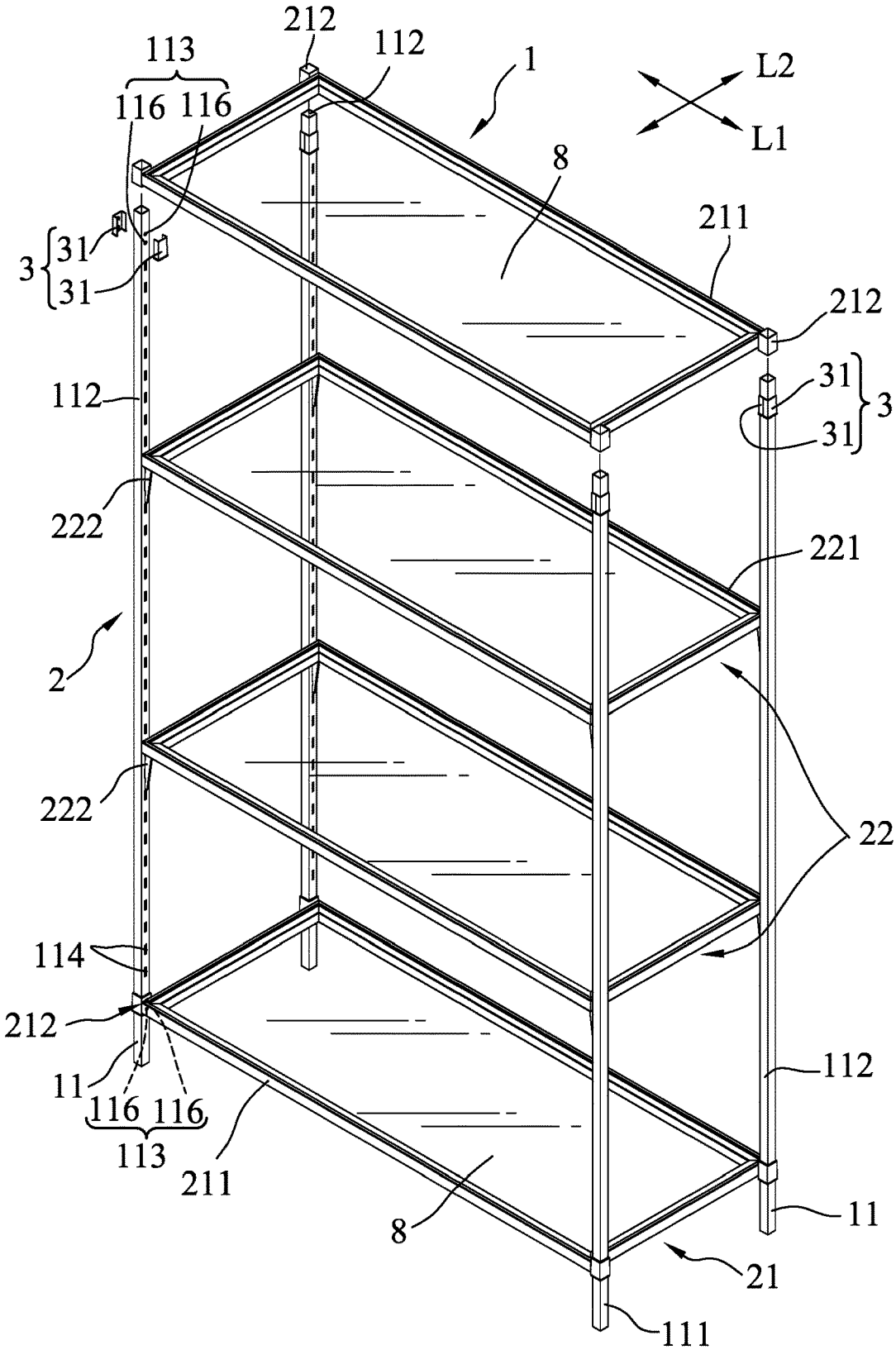
FIG. 2 is a partly exploded perspective view illustrating a modular rack assembly according to an embodiment of the disclosure.
Figure 3:
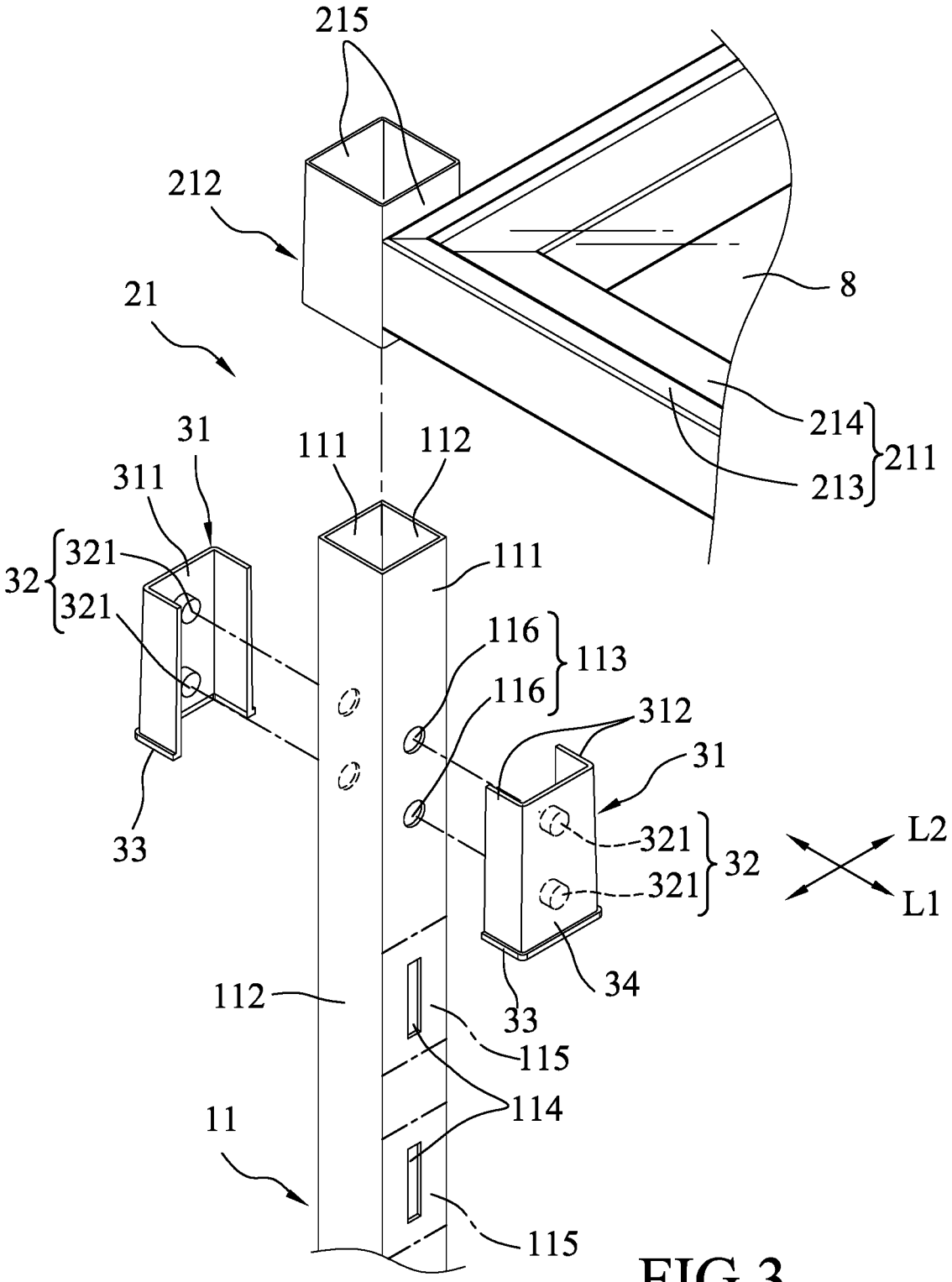
FIG. 3 is a fragmentary exploded perspective view of the embodiment illustrating a first shelf unit and an upright support leg of the modular rack assembly.
Figure 4:
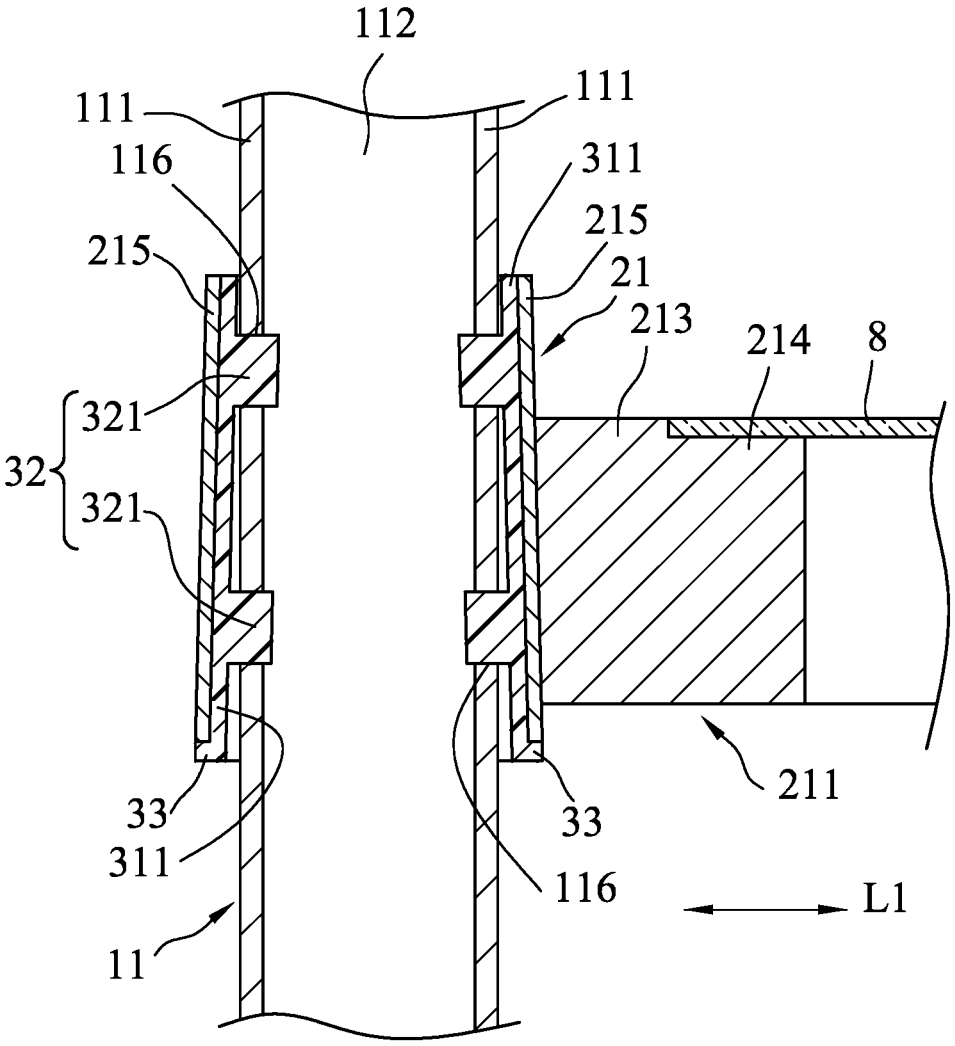
FIG. 4 is a fragmentary sectional view of the embodiment illustrating the first shelf unit assembled to the upright support leg.

Referring to FIGS. 2 to 4, a modular rack assembly according to an embodiment of the disclosure includes a support rod module 1 and a shelf module 2.

The support rod module 1 includes four upright support legs 11 spaced apart from each other. Each of the upright support legs 11 is a square tube elongated in a top-bottom direction, and has two first walls 111 opposite to each other in a first direction (L1) and two second walls 112 which are spaced apart from each other in a second direction (L2) transverse to the first direction (L1) and each of which is connected between the first tube walls 111.

Each of the upright support legs 11 includes four first hole units 113 spaced apart from each other in the top-bottom direction. In this embodiment, each of the first walls 111 has two first hole units 113 spaced apart from each other in the top-bottom direction. Especially, each of the first walls 111 includes a plurality of second holes 114 that are disposed between the two first hole units 113, that are spaced apart from each other in the top-bottom direction, and that extend therethrough in the first direction (L1), and a plurality of positioning portions 115 that are disposed between the two first hole units 113 and that respectively surround and define the second holes 114.

Each of the first hole units 113 includes two first holes 116 that are spaced apart from each other in the top-bottom direction. That is to say, for each of the upright support legs 11, each of the two first hole units 113 includes two pairs of the first holes 116 spaced apart from each other in the top-bottom direction, and each pair of the first holes 116 are aligned with each other along the first direction (L1). In this embodiment, each first hole 116 is circular. Each second hole 114 is rectangular in shape and is elongated in the top-bottom direction. However, in other embodiments of the disclosure, each first unit hole unit 113 may include only one first hole 116 that can be designed as a rectangular hole elongated in the top-bottom direction.

The shelf module 2 is removably mounted to the support rod module 1, and includes two first shelf units 21 and two second shelf units 22. The first shelf units 21 are spaced apart from each other in the top-bottom direction and each of the first shelf units 21 is removably engaged to a corresponding one of the two pairs of the first hole units 113 of each of the upright support legs 11. Each of the second shelf units 22 is removably engaged to ones of the second holes 114 of the upright support legs 11 which are at the same height. In other embodiments of the disclosure, the shelf module 2 may include only one second shelf unit 22.

Each of the first shelf units 21 includes four position-limiting members 3 each of which is removably engaged to a corresponding one of the two pairs of the first hole units 113 of a respective one of the upright support legs 11, a first shelf plate 211 disposed among the upright support legs 11, and four sleeves 212 that are connected to the first shelf plate 211 and that are removably and respectively sleeved on the position-limiting members 3 such that downward removal of the sleeves 212 from the position-limiting members 3 is prevented.

An outer dimension of each of the position-limiting members 3 is increased downwardly. In this embodiment, each of the position-limiting members 3 has two tube halves 31 that are open toward each other and that abut against each other to form a tube, two protrusion units 32 that respectively protrude from inner surfaces of the tube halves 31 toward each other and that are removably engaged with the corresponding ones of the pairs of the first hole units 113 of each of the upright support legs 11, and two flanges 33.

Each of the two tube halves 31 has a positioning portion 311, two abutting portions 312, and an outer surrounding surface 34. The positioning portion 311 is widened downwardly and has a corresponding one of the two protrusion units 32. The abutting portions 312 are respectively connected to two ends of the positioning portion 311 opposite to each other in the second direction (L2) and extend toward the other one of the two tube halves 31. The outer surrounding surface 34 is opposite to a corresponding one of the inner surfaces of the tube halves 31.

Each of the protrusion units 32 has two protrusions 321 that are disposed spaced apart in the top-bottom direction from each other and that protrude from a corresponding one of the positioning portions 311 of the tube halves 31. The protrusions 321 of the protrusion units 32 are respectively inserted into the first holes 116 of the first hole units 113. In other embodiments of the disclosure, each of the protrusion units 32 may have only one protrusion 211.

For each of the position-limiting members 3, the flanges 33 respectively and outwardly extend from bottom ends of the outer surrounding surfaces 34 of the tube halves 31, so as to allow bottom ends of the sleeves 212 of the first shelf units 21 to abut against the flanges 33, respectively, thereby positioning the first shelf units 21 relative to the support rod module 1. In other embodiments of the disclosure, the flanges 33 may be omitted as long as the downward removal of the sleeves 212 from the position-limiting members 3 can be prevented by the outer surrounding surfaces 34.

The first shelf plate 211 is a hollow rectangular plate, and has an outer surrounding portion 213 and an inner surrounding portion 214 connected to and surrounded by the outer surrounding portion 213. A top surface of the inner surrounding portion 214 is disposed below a top surface of the outer surrounding portion 213 for placement of a plate body 8 on the top surface of the inner surrounding portion 214 to support articles (not shown) on the plate body 8. In other embodiments, the first shelf plate 211 may be a solid plate or a grid panel.

Each of the sleeves 212 is a quadrilateral tube, and an inner dimension of each of the sleeves 212 is increased downwardly. In this embodiment, each of the sleeves 212 has two attachment walls 215 that are opposite to each other in the first direction (L1) and that are inclined outwardly and downwardly. Each of the attachment walls 215 is attached to the outer surrounding surface 34 of a corresponding one of the tube halves 31, and abuts against a corresponding one of the flanges 33, so that each of the sleeves 212 abuts downwardly against and is positioned to a corresponding one of the position-limiting members 3. The sleeves 212 are fixed to the first shelf plate 211 by, but not limited to, welding.

Figure 5:
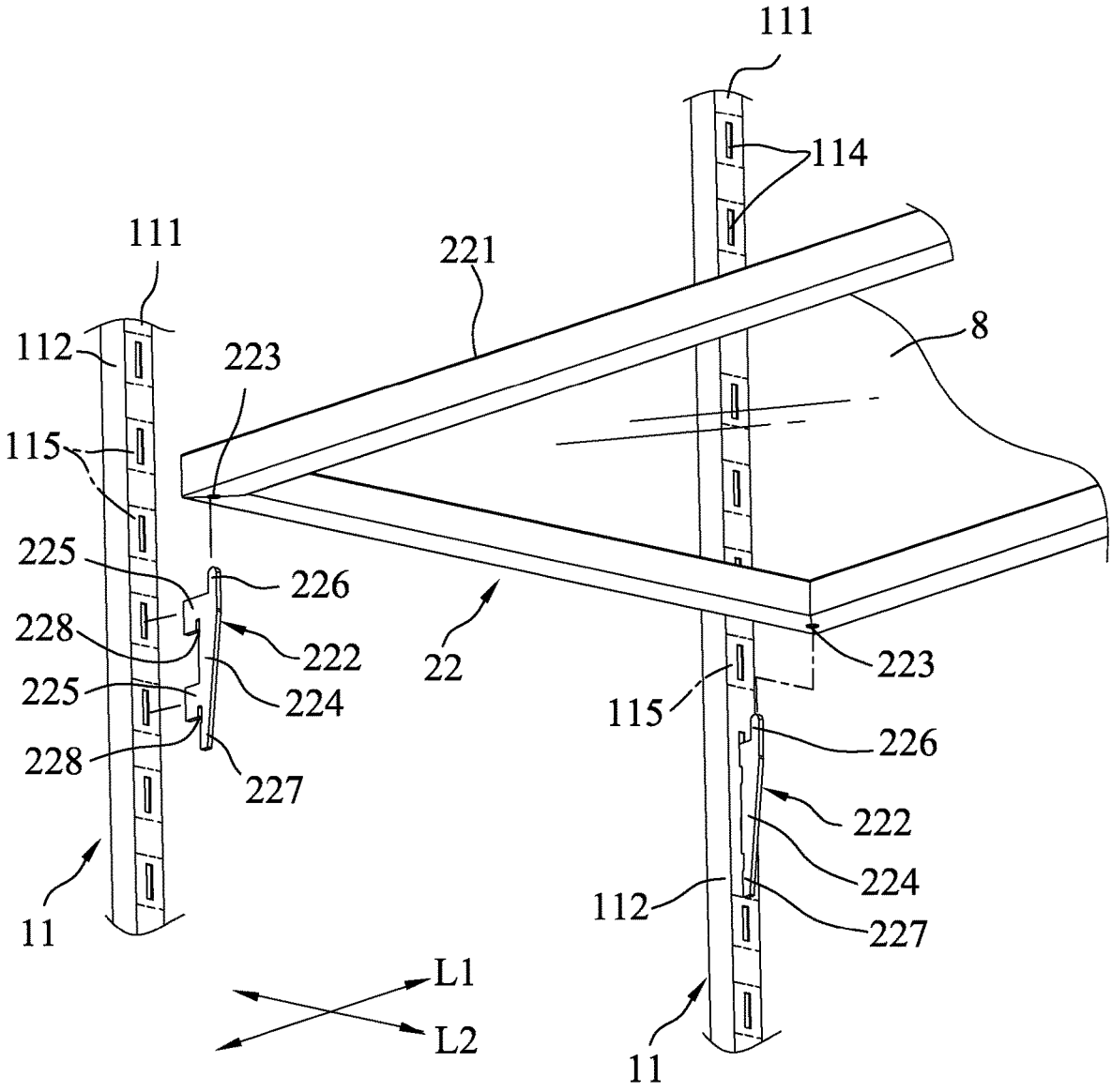
FIG. 5 is a fragmentary partly exploded perspective view of the embodiment illustrating how a second shelf unit is assembled to the upright support legs.
Figure 6:
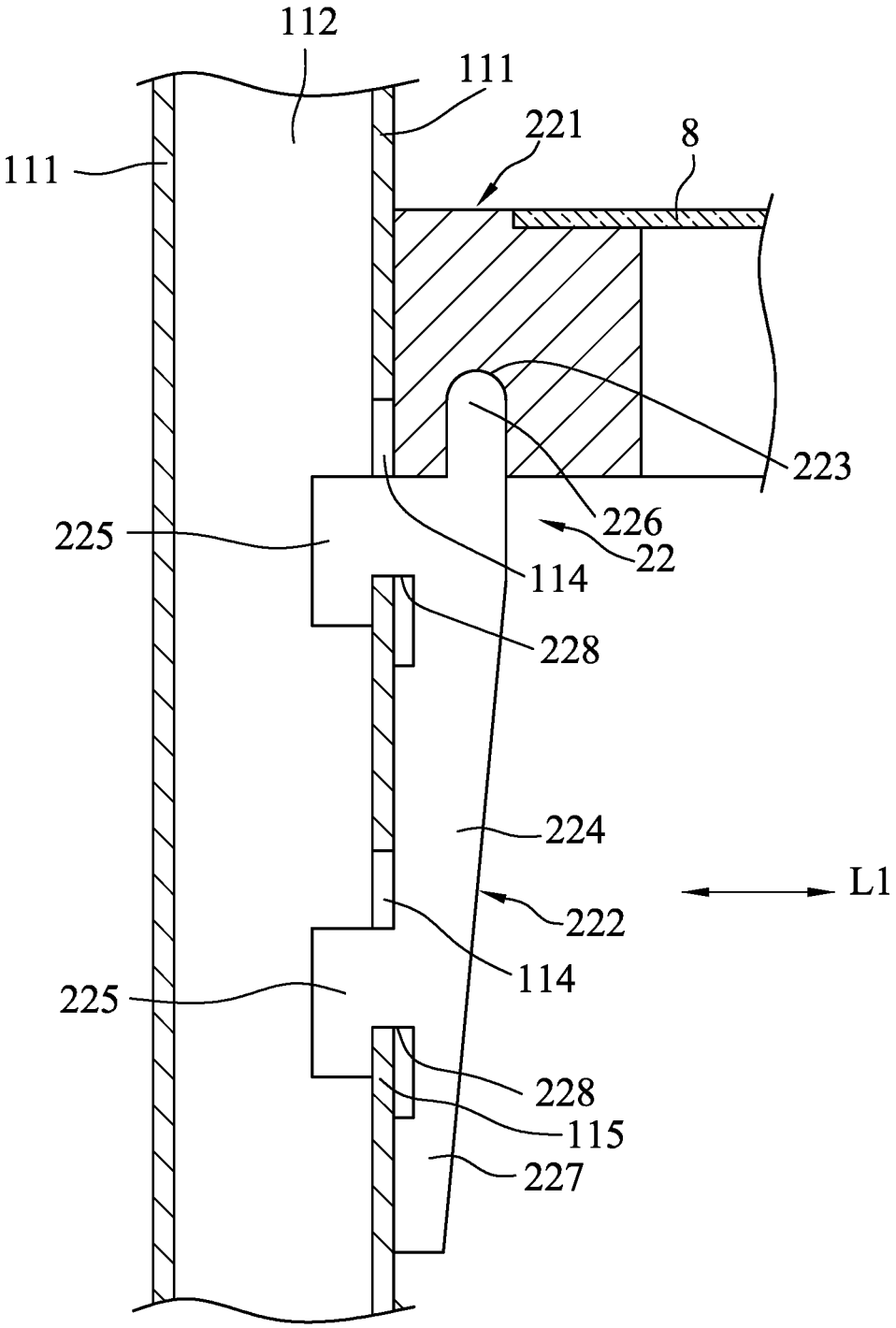
FIG. 6 is a fragmentary sectional view of the embodiment illustrating the second shelf unit assembled to the upright support leg.

Referring to FIGS. 5 and 6, each of the second shelf units 22 includes a second shelf plate 221 that is disposed among the upright support legs 11, and four supporting members 222 that are removably and respectively engaged to the ones of the second holes 114 at the same height and that are respectively inserted into the insertion holes 223 to support the second shelf plate 221.

The second shelf plate 221 is similar in structure to the first shelf plate 211. However, the difference of the second shelf plate 221 from the first shelf plate 211 resides in that the second shelf plate 221 has four insertion holes 223 that are formed at four corners of a bottom surface thereof and that are open downwardly. In this embodiment, each of the insertion holes 223 is circular. However, the shape of each of the insertion holes 223 is not limited thereto as long as the supporting members 222 are allowed to be respectively and stably inserted into the insertion holes 223.

Each of the supporting members 222 has a main body portion 224 extending in the top-bottom direction, two side insertion portions 225 which extend laterally from the main body portion 224 and each of which is inserted into a corresponding one of the second holes 114 of a corresponding one of the upright support legs 11, and a top insertion portion 226 extending upwardly from a top end of the main body portion 224 and inserted into a corresponding one of the insertion holes 223 of the second shelf plate 221. In this embodiment, the two side insertion portions 225 are spaced apart from each other in the top-bottom direction. Each of the two side insertion portions 225 has an engagement slot 228 that extends transversely therethrough and that is open downwardly. Each of the supporting members 222 further has an anti-rotation portion 227 that extends downwardly from a bottom end of the main body portion 224, that abuts against a corresponding one of the first walls 111 of a corresponding one of the upright support legs 11, and that defines a lateral side of the corresponding engagement slot 228. In other embodiments of the disclosure, each of the supporting members 222 may have only one side insertion portion 225, and the anti-rotation portion 227 may be omitted.

During assembly of the modular rack assembly, four position-limiting members 3 are engaged to the corresponding first hole units 113 of the upright support legs 11 located at bottom end portions of the upright support legs 11 by first inserting the protrusions 321 of the protrusion units 32 of the position-limiting members 3 respectively into the first holes 116 of the corresponding first hole units 113 until the two tube halves 31 of each of the position-limiting members 3 are interconnected in such a manner that the abutting portions 312 of one of the two tube halves 31 abut respectively against the abutting portions 312 of the other one of the two tube halves 31. Next, the sleeves 212 connected to the first shelf plate 211 of one of the two first shelf units 21 are respectively sleeved on the position-limiting members 3, so that the one of the two first shelf units 21 is positioned to the bottom end portions of the upright support legs 11. In the same way, the other one of the two first shelf units 2 can be positioned to the top end portions of the upright support legs 11.

Because the first shelf units 21 and the upright support legs 11 cooperate with each other to form a stable quadrilateral structure, the second shelf units 22 are allowed to be laterally moved into or removed from a storage space defined among the first shelf units 21 and the upright support legs 11.

To assemble one of the two second shelf units 22 to the upright legs 11, each of the side insertion portions 225 of each supporting member 222 of the one of the second shelf units 22 is inserted into a corresponding one of the second holes 114 of the upright support legs 11, in a manner that the engagement slot 228 of each of the corresponding side insertion portions 225 is engaged downwardly with a corresponding one of the positioning portions 115, and the corresponding anti-rotation portion 227 abuts against a corresponding one of the first walls 111 of the corresponding upright support leg 11, thereby preventing each of the supporting members 222 from being rotated and disengaged from the corresponding upright support leg 11. After the insertion holes 223 of the second shelf plate 221 are respectively aligned with the top insertion portions 226 of the supporting members 222, and after the second shelf plate 221 of the one of the second shelf units 22 is moved downwardly, the top insertion portions 226 are respectively inserted into the insertion holes 223 so that the one of the second shelf units 22 is assembled to the upright support legs 11 at a predetermined height. In the same way, the other one of the second shelf units 22 can be assembled to the upright support legs 11 at another predetermined height.

When one of the second shelf units 22 is needed to be adjusted in position, the corresponding second shelf plate 221 is moved upwardly to disengage from the corresponding supporting members 222, and then the corresponding supporting members 222 are moved so as to be engaged to the second holes 114 at a new height. After the corresponding second shelf plate 221 is supported by the corresponding support members 222, the height adjustment of the corresponding second shelf unit 22 is finished.

Therefore, when the lower second shelf unit 22 is needed to be removed or adjusted in height, or when the number of the second shelf units 22 is needed to be increased, there is no need to disengage the upper first shelf unit 21 and the upper second shelf unit 22 from the upright support legs 11. Especially by virtue of the second shelf plate 221 having the insertion holes 223, and by virtue of the supporting members 222 being removably engaged to the second holes 114 and being respectively inserted into the insertion holes 223 to support the second shelf plate 221, each second shelf unit 22 is quickly and laterally assembled to or disassembled from the upright support legs 11.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A modular rack assembly, comprising:

a support rod module including a plurality of upright support legs spaced apart from each other, each of said upright support legs having at least two first hole units spaced apart from each other in a top-bottom direction, and a plurality of second holes that are disposed between said at least two first hole units and that are spaced apart from each other in the top-bottom direction; and a shelf module removably mounted to said support rod module, and including two first shelf units which are spaced apart from each other in the top-bottom direction and each of which is removably engaged to a corresponding one of said at least two first hole units of each of said upright support legs, each of said first shelf units including a plurality of position-limiting members each of which is removably engaged to a corresponding one of said at least two first hole units of a respective one of said upright support legs, a first shelf plate disposed among said upright support legs, and a plurality of sleeves that are connected to said first shelf plate and that are removably and respectively sleeved on said position-limiting members such that downward removal of said sleeves from said position-limiting members is prevented, and at least one second shelf unit being removably engaged to ones of said second holes of said upright support legs which are at [[the]]a same height, said at least one second shelf unit including a second shelf plate that is disposed among said upright support legs and that has a plurality of insertion holes open downwardly, and a plurality of supporting members that are removably and respectively engaged to said ones of said second holes at the same height and that are respectively inserted into said insertion holes to support said second shelf plate wherein each of said supporting members has a main body portion extending in the top-bottom direction, at least one side insertion portion extending laterally from said main body portion and inserted into a corresponding one of said second holes of a corresponding one of said upright support legs, and a top insertion portion extending upwardly from a top end of said main body portion and inserted into a corresponding one of said insertion holes of said second shelf plate;

wherein each of said upright support legs is an elongated tubular member and has a tubular wall, said tubular wall of each of said upright support legs having a plurality of positioning portions respectively surrounding and defining said second holes, said at least one side insertion portion of each of said supporting members having an engagement slot that extends transversely through said at least one side insertion portion and that is open downwardly, said at least one side insertion portion of each of said supporting members being inserted into said corresponding one of said second holes in a manner that said engagement slot is engaged downwardly with a corresponding one of said positioning portions; and wherein each of said supporting members further has an anti-rotation portion that extends downwardly from a bottom end of said main body portion, that abuts against said tubular wall of a corresponding one of said upright support legs, and that defines a lateral side of said engagement slot.

2. The modular rack assembly as claimed in claim 1, wherein each of said position-limiting members has two tube halves that are open toward each other and that abut against each other to form a tube, and two protrusion units that respectively protrude from inner surfaces of said tube halves toward each other and that are removably engaged with said corresponding one of said at least two first hole units, an outer dimension of each of said position-limiting members being increased downwardly, an inner dimension of each of said sleeves of each of said first shelf units being increased downwardly, each of said sleeves abutting downwardly against and being positioned to a corresponding one of said position-limiting members.

3. The modular rack assembly as claimed in claim 2, wherein each of said tube halves has an outer surrounding surface opposite to a corresponding one of said inner surfaces of said tube halves, each of said position-limiting members further having two flanges respectively and outwardly extending from bottom ends of said outer surrounding surfaces of said tube halves, so as to allow bottom ends of said sleeves of said first shelf units to abut against said flanges, respectively, thereby positioning said first shelf units relative to said support rod module.

4. A modular rack assembly comprising:

a support rod module including a plurality of upright support legs spaced apart from each other, each of said upright support legs having at least two first hole units spaced apart from each other in a top-bottom direction, and a plurality of second holes that are disposed between said at least two first hole units and that are spaced apart from each other in the top-bottom direction; and a shelf module removably mounted to said support rod module, and including two first shelf units which are spaced apart from each other in the top-bottom direction and each of which is removably engaged to a corresponding one of said at least two first hole units of each of said upright support legs, each of said first shelf units including a plurality of position-limiting members each of which is removably engaged to a corresponding one of said at least two first hole units of a respective one of said upright support legs, a first shelf plate disposed among said upright support legs, and a plurality of sleeves that are connected to said first shelf plate and that are removably and respectively sleeved on said position-limiting members such that downward removal of said sleeves from said position-limiting members is prevented, and at least one second shelf unit being removably engaged to ones of said second holes of said upright support legs which are at a same height, said at least one second shelf unit including a second shelf plate that is disposed among said upright support legs and that has a plurality of insertion holes open downwardly, and a plurality of supporting members that are removably and respectively engaged to said ones of said second holes at the same height and that are respectively inserted into said insertion holes to support said second shelf plate;

wherein each of said position-limiting members has two tube halves that are open toward each other and that abut against each other to form a tube, and two protrusion units that respectively protrude from inner surfaces of said tube halves toward each other and that are removably engaged with said corresponding one of said at least two first hole units, an outer dimension of each of said position-limiting members being increased downwardly, an inner dimension of each of said sleeves of each of said first shelf units being increased downwardly, each of said sleeves abutting downwardly against and being positioned to a corresponding one of said position-limiting members; and wherein each of said upright support legs is a square tube, and has two first walls opposite to each other in a first direction and two second walls which are spaced apart from each other in a second direction transverse to the first direction and each of which is connected between said first tube walls, each of said upright support legs including four of said first hole units, each of said first walls having two of said first hole units spaced apart from each other in the top-bottom direction, each of said tube halves of each of said position-limiting members having a positioning portion that is widened downwardly and that has a corresponding one of said two protrusion units, and two abutting portions that are respectively connected to two ends of said positioning portion opposite to each other in the second direction and that extend toward the other one of said tube halves, said two tube halves of each of said position-limiting members being interconnected in such a manner that said abutting portions of one of said two tube halves abut respectively against said abutting portions of the other one of said two tube halves.

5. The modular rack assembly as claimed in claim 4, wherein each of said protrusion units of each of said position-limiting members has two protrusions that are disposed spaced apart in the top-bottom direction from each other and that protrude from a corresponding one of said positioning portions of said tube halves, each of said first hole units including two first holes spaced apart from each other in the top-bottom direction, said protrusions of said protrusion units of said position-limiting members being respectively inserted into said first holes of said first hole units.

* * * * *